US005854606A

United States Patent [19]

Kawahata et al.

[11] Patent Number: 5,854,606

[45] **Date of Patent: *Dec. 29, 1998**

[54] SURFACE-MOUNT ANTENNA AND COMMUNICATION APPARATUS USING SAME

[75] Inventors: Kazunari Kawahata, Kyoto; Kazuhisa Yamaki, Muko, both of Japan

[73] Assignee: Murata Manufacturing Co. Ltd., Kyoto, Japan

[ * ] Notice: The term of this patent shall not extend beyond the expiration date of Pat. No. 5,668,557.

[21] Appl. No.: 733,297

[22] Filed: Oct. 17, 1996

[30] Foreign Application Priority Data

Oct. 17, 1995 [JP] Japan ..... 7-268790

[51] Int. Cl.[6] ..... H01Q 1/24; H01Q 1/38

[52] U.S. Cl. ..... 343/702; 343/700 MS

[58] Field of Search ..... 343/702, 700 MS, 343/829, 830, 831; H01Q 1/24, 1/38

[56] References Cited

U.S. PATENT DOCUMENTS 5,668,557 9/1997 Kawahata ..... 343/702
5,684,492 11/1997 Kagoshima et al. ..... 343/702

*Primary Examiner*—Hoanganh T. Le
*Attorney, Agent, or Firm*—Ostrolenk, Faber, Gerb & Soffen, LLP

[57] ABSTRACT

A compact surface-mount antenna is constructed from a rectangular-prism-shaped base member made from a dielectric material or a magnetic material. A through-hole is formed between one end-face and the opposing end-face in the base member. A radiation electrode is formed on the inside surface of the through-hole. One end of the radiation electrode is connected to a ground electrode formed on the one end-face, and the other end of the radiation electrode serves as an open end on the opposite end-face. A power-supplying electrode is formed through a dielectric gap disposed around the open end on the opposite end-face.

59 Claims, 6 Drawing Sheets

SURFACE-MOUNT ANTENNA AND COMMUNICATION APPARATUS USING SAME

BACKGROUND OF THE INVENTION

1. Field of the Invention

The present invention relates to a surface-mount antenna and communication apparatus using the same which are used in radio local area networks (LAN) and mobile communications equipment such as portable telephones.

2. Description of the Related Art

FIG. 10 shows a conventional λ/4 surface-mount antenna. Through-holes 72 and 73 are provided between one pair of end-faces 71*a* and 71*b* in a dielectric base member 71. A first radiation electrode 74 and a second radiation electrode 75 are formed at the inside surfaces of the through-holes 72 and 73, respectively. One end of the first radiation electrode 74 is connected to one end of a pattern electrode 76 formed on one end-face 71*a,* and the other end of the first radiation electrode 74 serves as an open end 74*a* on the opposite end-face 71*b*. One end of the second radiation electrode 75 is connected to the other end of the pattern electrode 76, and the other end of the second radiation electrode 75 is connected to a ground electrode 77.

There is also shown a power-supplying terminal pin 78. A metal pin 78*b* electrically connected to a power-supplying terminal 78*a* is covered with resin 78*c*. The power-supplying terminal pin 78 is inserted into the through-hole 72 having the first radiation electrode 74 which creates a capacitor between the metal pin 78*b* and the first radiation electrode 74 with the resin 78*c* serving as a dielectric. With this capacitor, a high-frequency signal f is electromagnetically coupled to the first radiation electrode 74 to cause high-frequency current to flow to ground through the first radiation electrode 74, the pattern electrode 76, and the second radiation electrode 75. With this configuration, a radio wave is emitted.

In the conventional surface-mount antenna, the electromagnetic coupling level between the power-supplying terminal pin 78 and the first radiation electrode 74 is affected by the quality of the electrical connection between the power-supplying terminal pin 78 and the first radiation electrode 74. The manner in which the terminal pin 78 is inserted may cause a frequency change. Also, general exposure due to aging or dropping of the antenna may disturb the connection at the terminal pin 78 causing a large frequency shift. Furthermore, since the power-supplying terminal pin 78 is required, the antenna becomes large and is prevented from being made compact.

Similarly, a communication apparatus using such a conventional surface-mount antenna also has the same drawbacks as the surface mount antenna and is prevented from being made compact by the bulkiness of the antenna itself.

SUMMARY OF THE INVENTION

Accordingly, it is an object of the present invention to provide a compact surface-mount antenna having no frequency shift due to general exposure due to aging or dropping of the antenna, and a communication apparatus using the same.

The foregoing and other objects are achieved in one aspect of the present invention through the provision of a surface-mount antenna comprising: a base member made from a dielectric member or a magnetic member; a through-hole formed between one end-face and the opposite end-face in the base member; a ground electrode formed on the one end-face; a radiation electrode formed on the inside surface of the through-hole, one end of the radiation electrode being connected to the ground electrode and the other end serving as an open end on the opposite end-face; and a power-supplying electrode formed through a base-member gap disposed around the open end on the opposite end-face.

In the surface-mount antenna having one through-hole, the open end of the radiation electrode is disposed on an end-face of the dielectric base member and power is supplied through a gap capacitor formed between the open end and the power-supplying electrode.

By cutting the power-supplying electrode formed on this end-face through the dielectric gap to change the coupling capacitance, electromagnetic coupling is adjusted.

The foregoing and other objects are achieved in another aspect of the present invention through the provision of a surface-mount antenna comprising: a base member made from a dielectric member or a magnetic member; a through-hole formed between one end-face and the opposite end-face in the base member; a ground electrode formed on the one end-face; a power-supplying electrode formed on the opposite end-face; and a radiation electrode formed at a certain portion on the inside surface of the through-hole, wherein one end of the radiation electrode is connected to the ground electrode and the other end extends to the vicinity of the opposite end-face (power-supplying electrode) and serves as an open end.

In the surface-mount antenna having one through-hole, since the open end of the radiation electrode formed in the through-hole is located in the through-hole and the gap is provided in the through-hole from the open end to the power-supplying electrode, characteristics adjustment such as that for the frequency is performed by cutting the gap in the through-hole.

The foregoing and other objects are achieved in still another aspect of the present invention through the provision of a surface-mount antenna comprising: a base member made from a dielectric member or a magnetic member; a hole having a bottom formed from one end-face to the vicinity of the opposite end-face in the base member; a radiation electrode formed on the inside surface of the hole having a bottom; and a ground electrode formed on the one end-face; wherein one end of the radiation electrode is connected to the ground electrode and the other end serves as an open end in the vicinity of the opposite end-face, and a power-supplying electrode is formed on the opposite end-face at a position in-line with the extended axis of the hole having a bottom.

In the surface-mount antenna having one through-hole, a capacitor is formed at a gap made between the power-supplying electrode and the bottom of the hole which serves as the open end of the radiation electrode. The gap length determines the capacitance. Frequency adjustment is performed by cutting the power-supplying electrode.

The foregoing and other objects are achieved in yet another aspect of the present invention through the provision of a surface-mount antenna comprising: a base member made from a dielectric member or a magnetic member; at least a first through-hole and a second through-hole formed between one end-face and the opposite end-face in the base member; a pattern electrode formed on the one end-face; a ground electrode formed on the opposite end-face; and a first radiation electrode and a second radiation electrode formed on the inside surfaces of the first through-hole and the second through-hole, wherein one end of each of the first radiation electrode and the second radiation electrode is connected to both ends of the pattern electrode, the other end of the first radiation electrode serves as an open end on the opposite end-face, the other end of the second radiation electrode is connected to the ground electrode, and a power-supplying electrode is formed through a base-member gap disposed around the open end on the opposite end-face.

The foregoing and other objects are achieved in another aspect of the present invention through the provision of a surface-mount antenna comprising: a base member made from a dielectric member or a magnetic member; at least a first through-hole and a second through-hole formed between one end-face and the opposite end-face in the base member; a pattern electrode formed on the opposite end-face; a power-supplying electrode formed on the one end-face; a ground electrode formed on the one end-face; and a first radiation electrode and a second radiation electrode formed on the inside surfaces of the first through-hole and the second through-hole, respectively, wherein one end of each of the first radiation electrode and the second radiation electrode is connected to both ends of the pattern electrode, the other end of the first radiation electrode extends to the vicinity of the power-supplying electrode and serves as an open end, and the other end of the second radiation electrode is connected to the ground electrode.

The foregoing and other objects are achieved in a yet further aspect of the present invention through the provision of a surface-mount antenna comprising: a base member made from a dielectric member or a magnetic member; a hole having a bottom formed from one end-face to the vicinity of the opposite end-face in the base member; at least one through-hole formed between the one end-face and the opposite end-face; a pattern electrode formed on the one end-face; a ground electrode formed on the opposite end-face; and a first radiation electrode and a second radiation electrode formed on the inside surfaces of the hole having a bottom and the through-hole, respectively, wherein one end of the first radiation electrode in the hole having a bottom is connected to one end of the pattern electrode and the other end of the first radiation electrode serves as an open end in the vicinity of the opposite end-face, a power-supplying electrode is formed on the opposite end-face at a position in-line with the extended axis of the open end of the hole having a bottom, and one end of the second radiation electrode is connected to the other end of the pattern electrode and the other end of the second radiation electrode is connected to the ground electrode.

Since the surface-mount antennas each having at least two holes are provided with a plurality of radiation electrodes in which high-frequency currents flow in different directions and also provided with a pattern electrode in which a high-frequency current flows in a direction which intersects those in which the currents flow in the radiation electrodes, the radiation pattern has no null point. In addition, compared with a surface-mount antenna having one through-hole, the frequency can be reduced more if the same chip size is used, and the chip size can be made smaller if the same frequency is used.

The descriptions of the above-described surface-mount antennas having one through-hole are roughly applied to the corresponding surface-mount antennas having at least two holes, described above.

According to the present invention, since the function of a coupling capacitor is obtained by a gap formed between the open end of the radiation electrode and the power-supplying electrode without using a coupling terminal pin, unlike a conventional surface-mount antenna, frequency is not shifted due to aging or dropping the antenna, and the surface-mount antenna can be made compact.

The foregoing and other objects are achieved in a still further aspect of the present invention through the provision of a communication apparatus wherein one of the above-described surface-mount antennas is mounted.

The communication apparatus having one of the above-described surface-mount antennas benefits from the following features of such an antenna: no frequency shift, compactness, and a low null point in the radiation pattern.

Other features and advantages of the present invention will become apparent from the following description of the invention which refers to the accompanying drawings.

DETAILED DESCRIPTION OF EMBODIMENTS OF THE INVENTION

Figure 1:
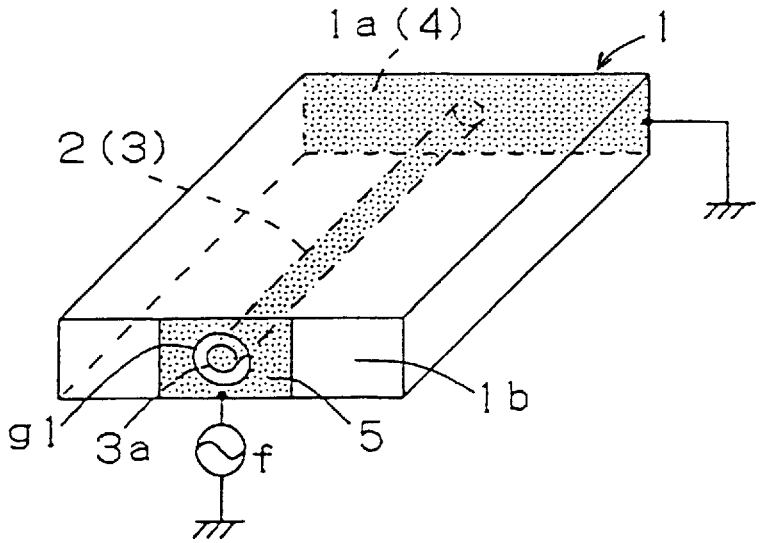
FIG. 1 is a perspective view of a surface-mount antenna according to a first embodiment of the present invention.

Embodiments of the present invention will be described below by referring to the drawings.

FIG. 1 shows a first embodiment of the present invention. There is shown a rectangular-prism-shaped base member 1 made from a dielectric material such as ceramic and resin. A through-hole 2 is formed between one end-face 1*a* and the opposite end-face 1*b*. A $\lambda/4$ radiation electrode 3 is formed on the inside surface of the through-hole 2. One end of the radiation electrode 3 is connected to a ground electrode 4 formed on one end-face 1*a*, and the other end serves as an open end 3*a* on the opposite face 1*b*. A power-supplying electrode 5 is formed around the open end 3*a* on one end-face 1*b* with a dielectric gap g1 disposed therebetween. Power is supplied through a capacitor formed at the gap g1.

Figure 7:
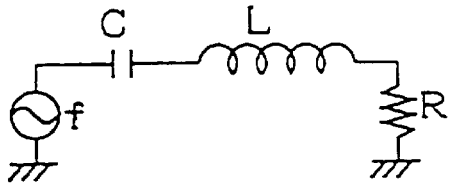
FIG. 7 is an electrical equivalent circuit diagram of the surface-mount antenna alternatives shown in FIGS. 1 to 3.

FIG. 7 shows the electrical equivalent circuit of FIG. 1. In FIG. 7, C indicates a coupling capacitor formed at the gap g1 between the open end 3*a* of the radiation electrode 3 and the power-supplying electrode 5, L indicates a radiation inductance of the radiation electrode 3, and R indicates a radiation resistor. A frequency signal f is connected to a series circuit of the coupling capacitor C, the radiation inductor L, and the radiation resistor R. The high-frequency signal f resonates in series with the coupling capacitor C and the radiation inductance L, and is emitted from the radiation electrode 3 as a radio wave.

In this embodiment, frequency adjustment is performed by changing the size of, e.g., by cutting, the power-supplying electrode 5 disposed around the gap g1, the ground electrode 4, or the opening of the open end 3*a* of the radiation electrode 3.

Figure 2:
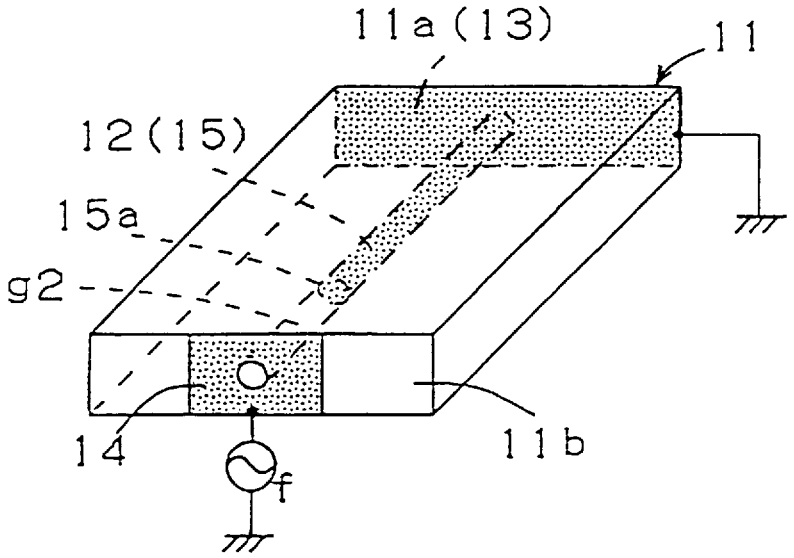
FIG. 2 is a perspective view of a surface-mount antenna according to a second embodiment of the present invention.

A second embodiment of the present invention will be described below by referring to FIG. 2. In a rectangular-prism-shaped base member 11 made from a dielectric material such as ceramic and resin, a through-hole 12 is formed between one end-face 11*a* and the opposite end-face 11*b*. A ground electrode 13 is formed on one end-face 11*a,* and a power-supplying electrode 14 is formed on the opposite end-face 11*b*. A radiation electrode 15 is formed at the specified portion on the inside surface of the through-hole 12. One end of the radiation electrode 15 is connected to the ground electrode 13, and the other end extends close to an end-face 11*b* (power-supplying electrode 14) and serves as an open end 15*a*. The through-hole 12 passes through the power-supplying electrode 14. A gap g2 is formed between the open end 15*a* of the radiation electrode 15 and the power-supplying electrode 14. Since a coupling capacitor is formed by this gap g2, frequency adjustment is performed mainly by cutting the open end 15*a* of the radiation electrode 15 to extend the gap g2. The electrical equivalent circuit diagram of FIG. 2 is also represented by FIG. 7. In the electrical equivalent circuit, C indicates the electrical equivalent of a coupling capacitance formed at the gap g2.

A third embodiment of the present invention will be described below by referring to FIG. 3. In a rectangular-prism-shaped base member 21 made from a dielectric material such as ceramic and resin, a hole 22 having a bottom is formed from one end-face 21*a* to the vicinity of the opposite end-face 21*b*. A radiation electrode 23 is formed on the inside surface of the through-hole 22. One end of the radiation electrode 23 is connected to a ground electrode 24 formed on one end-face 21*a,* and the other end serves as an open end 23*a* in the vicinity of the opposite end-face 21*b*. A power-supplying electrode 25 is formed on an end-face 21*b* at a position in-line with the extended axis of the hole 22 having a bottom. A gap g3 is formed between the open end 23*a* of the radiation electrode 23 and the power-supplying electrode 25, and the gap g3 forms a capacitor. Therefore, the depth of the hole 22 having a bottom determines the frequency. Frequency adjustment is performed mainly by cutting the power-supplying electrode 25 and the ground electrode 24 in this embodiment.

Figure 3:
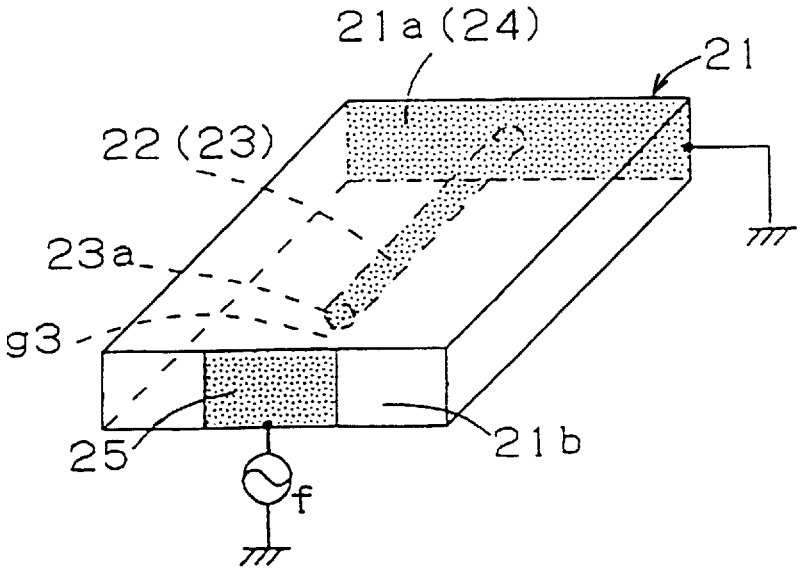
FIG. 3 is a perspective view of a surface-mount antenna according to a third embodiment of the present invention.

The electrical equivalent circuit diagram of the embodiment of FIG. 3 is also represented by FIG. 7. In the electrically equivalent circuit, C indicates a coupling capacitance formed at the gap g3.

A fourth embodiment of the present invention will be described below by referring to FIG. 4. In a rectangular-prism-shaped base member 31 made from a dielectric material such as ceramic and resin, a first through-hole 32 and a second through-hole 33 are formed in parallel between one end-face 31*a* and the opposite end-face 31*b*. A first radiation electrode 34 and a second radiation electrode 35 are formed on the inside surfaces of the first through-hole 32 and the second through-hole 33, respectively. One end of each of the first radiation electrode 34 and the second radiation electrode 35 is connected to a respective end of a pattern electrode 36 formed on one end-face 31*a*. The other end of the first radiation electrode 34 serves as an open end 34*a* on the opposite end-face 31*b*. Around the open end 34*a,* a power-supplying electrode 37 is formed on an end-face 31*b* with a dielectric gap g4 disposed therebetween. The other end of the second radiation electrode 35 is connected to a ground electrode 38 formed on end-face 31*b*.

Since the effective length of the combined radiation electrode which includes the first radiation electrode 34, the pattern electrode 36, and the second radiation electrode 35 is long in this embodiment, the antenna can be made more compact than those described in the first to third embodiments.

In this embodiment, frequency adjustment is performed in the same way as for the first embodiment by cutting the power-supplying electrode 37 around the gap g4, the ground electrode 38, or the opening of the open end 34*a* of the first radiation electrode 34.

Figure 4:
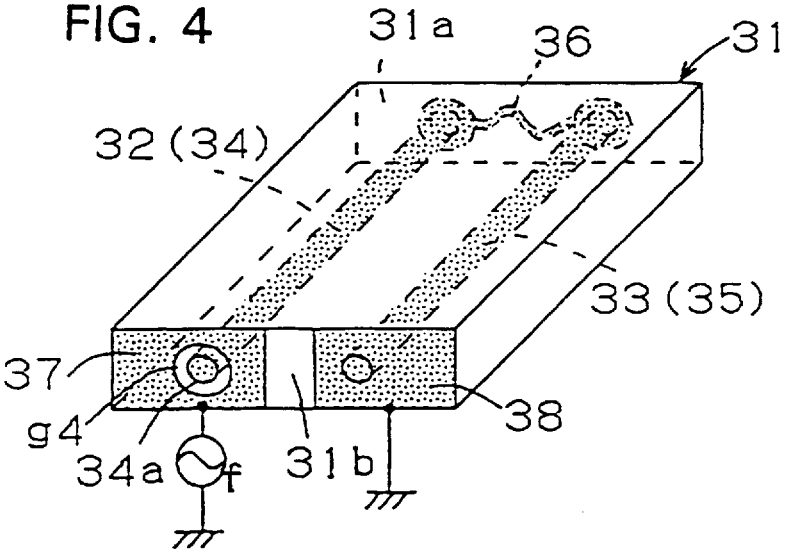
FIG. 4 is a perspective view of a surface-mount antenna according to a fourth embodiment of the present invention.
Figure 8:
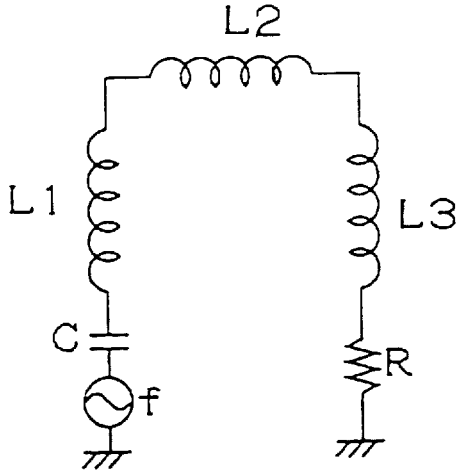
FIG. 8 is an electrical equivalent circuit diagram of the surface-mount antenna alternatives shown in FIGS. 4 to 6.

FIG. 8 shows the electrical equivalent circuit diagram of FIG. 4. In FIG. 8, C indicates a coupling capacitance formed by the gap g4 formed between the open end 34*a* of the first radiation electrode 34 and the power-supplying electrode 37, L1 indicates a radiation inductance of the first radiation electrode 34, L2 indicates the inductance of the pattern electrode 36, L3 indicates the radiation inductance of the second radiation electrode 35, and R indicates a radiation resistor. A high-frequency signal f is connected to these circuit components connected in series, and a radio wave is emitted from the first radiation electrode 34, the pattern electrode 36, and the second radiation electrode 35.

A fifth embodiment of the present invention will be described below by referring to FIG. 5. In a rectangular-prism-shaped base member 41 made from a dielectric material such as ceramic and resin, a first through-hole 42 and a second through-hole 43 are formed in parallel between one end-face 41*a* and the opposite end-face 41*b*. A first radiation electrode 47 and a second radiation electrode 48 are formed on the inside surfaces of the first through-hole 42 and the second through-hole 42, respectively. One end of each of the first radiation electrode 47 and the second radiation electrode 48 is connected to both ends of a pattern electrode 44 formed on one end-face 41*b*. The other end of the first radiation electrode 47 extends close to the vicinity of a power-supplying electrode 45 formed on one end-face 41*b* and serves as an open end 47*a*. The other end of the second radiation electrode 48 is connected to a ground electrode 46 formed on an end-face 41*b*.

In the same way as in the fourth embodiment, since the effective length of the combined radiation electrode which includes the first radiation electrode 47, the pattern electrode 44, and the second radiation electrode 48 is long in this embodiment, the antenna can be made more compact than those described in the first to third embodiments.

In this fifth embodiment, frequency adjustment is performed in the same way as for the second embodiment mainly by cutting the open end 47*a* of the first radiation electrode 47 to extend the gap g5.

Figure 5:
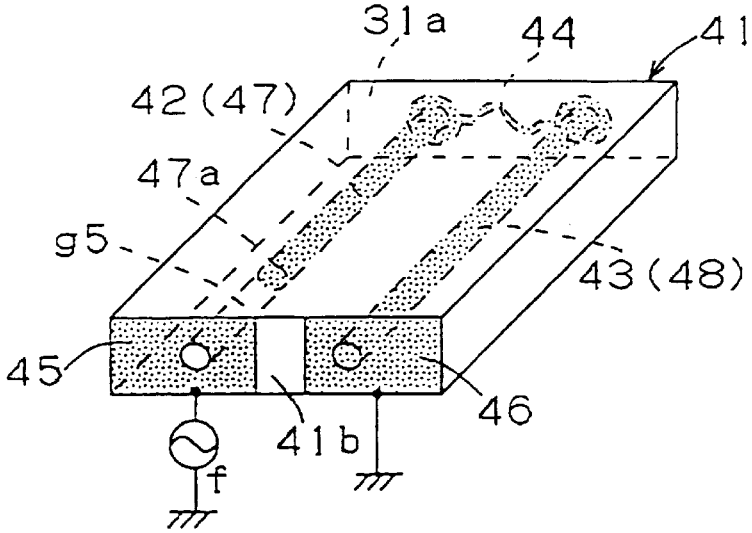
FIG. 5 is a perspective view of a surface-mount antenna according to a fifth embodiment of the present invention.

The electrical equivalent circuit diagram of the embodiment of FIG. 5 is also represented by FIG. 8. In the electrical equivalent circuit, C indicates a coupling capacitance formed at the gap g5 formed between the open end 47*a* of the first radiation electrode 47 and the power-supplying electrode 45.

A sixth embodiment of the present invention will be described below by referring to FIG. 6. In a rectangular-prism-shaped base member 51 made from a dielectric material such as ceramic and resin, a hole 52 having a bottom is formed from one end-face 51*a* to the vicinity of the opposite end-face 51*b*, and a through-hole 53 is formed in parallel to the hole 52 between one end-face 51*a* and the opposite end-face 51*b*. A first radiation electrode 54 and a second radiation electrode 55 are formed on the inside surfaces of the hole 52 having a bottom and the through-hole 53, respectively. One end of the first radiation electrode 54 in the hole 52 having a bottom is connected to one end of a pattern electrode 56 formed on one end-face 51*a*. The other end of the first radiation electrode 54 serves as an open end 54*a* in the vicinity of the opposite end 51*b*. A power-supplying electrode 57 is formed on an end-face 51*b* at a position in-line with the extended axis of the hole having a bottom. One end of the second radiation electrode 55 in the through-hole 53 is connected to the other end of the pattern electrode 56, and the other end of the second radiation electrode 55 is connected to a ground electrode 58 formed on an end-face 51*b*.

In the same way as in the fourth embodiment, since the effective length of the combined radiation electrode which includes the first radiation electrode 54, the pattern electrode 56, and the second radiation electrode 55 is long in this embodiment, the antenna can be made more compact than those described in the first to third embodiments.

In this embodiment, the depth of the hole 52 having a bottom determines the frequency. Frequency adjustment is performed in the same way as for the third embodiment by cutting the power-supplying electrode 57 and the ground electrode 58.

Figure 6:
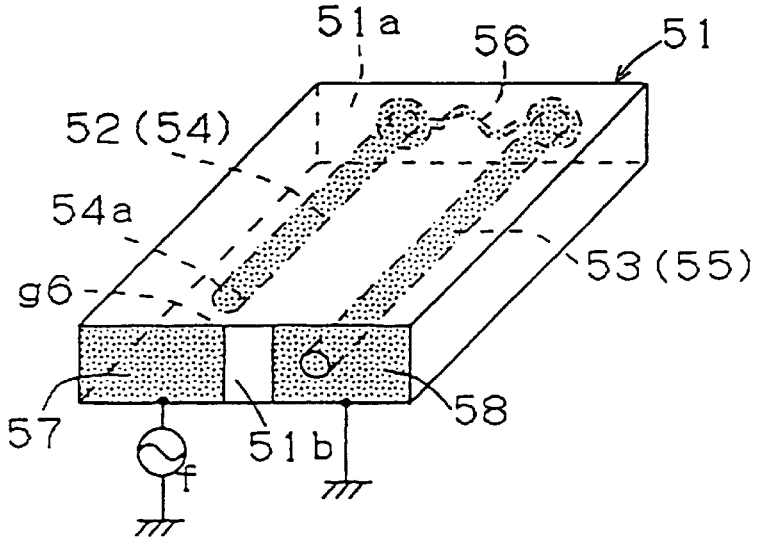
FIG. 6 is a perspective view of a surface-mount antenna according to a sixth embodiment of the present invention.

The electrical equivalent circuit diagram of the embodiment of FIG. 6 is also represented by FIG. 8. In the electrical equivalent circuit, C indicates a coupling capacitance formed at a gap g6 formed between the open end 54*a* of the first radiation electrode 54 and the power-supplying electrode 57.

Figure 11:
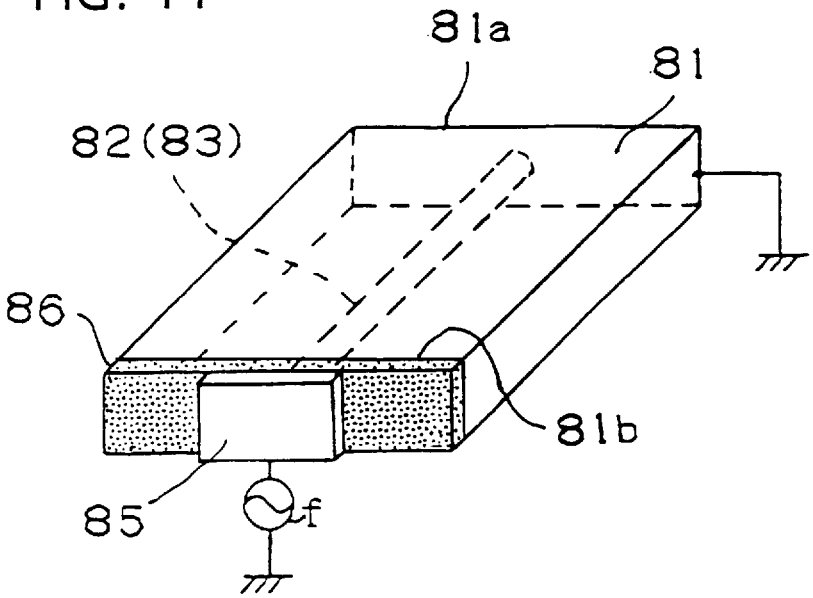
FIG. 11 is a perspective view of a further embodiment of the invention.
Figure 12:
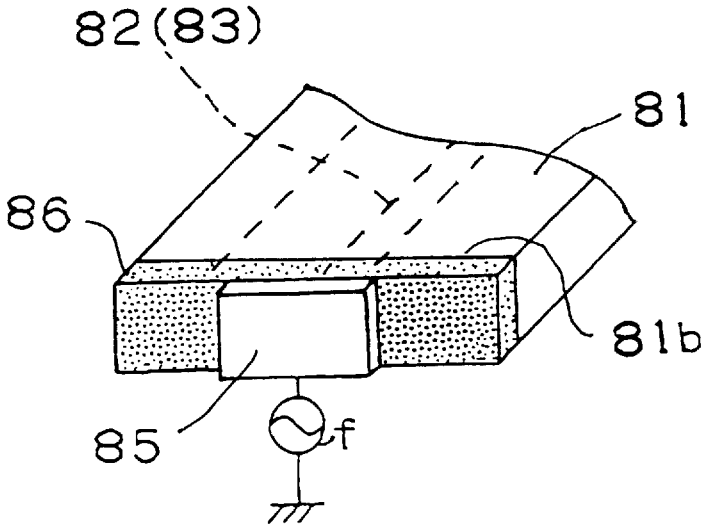
FIG. 12 is a perspective view of a detail of the embodiment of FIG. 11.

FIG. 11 shows a further embodiment of the surface mount antenna according to the present invention. The base member 81 has a hole 82 extending from a first end face 81*a* toward a second end face 81*b*. The hole 82 may be a through-hole or a hole that terminates prior to second end face 81*b*. A radiation electrode 83 is disposed on the inner surface of the through-hole 82. The radiation electrode may be disposed on the entire inner surface of hole 82 or on only a portion of it.

A resin member 86 made of non-conductive material is disposed on second end face 81*b*. The nature of the resin member 82 and its size and thickness will be determined by the desired capacitance. A power supplying electrode 85 for coupling between the radiation electrode 83 located inside the hole 82 and the power supplying electrode 85 can be disposed on either the whole surface of the resin member 86 or part of the surface of the resin member 86, as shown, so as to cover the hole 82, and preferably, the open portion of the hole 82 if it is a through-hole. The resin member 86 thereby forms a gap comprising a capacitance. The resin member need not cover the entire end face 81*b*, but only the portion underlying the electrode 85.

Figure 9:
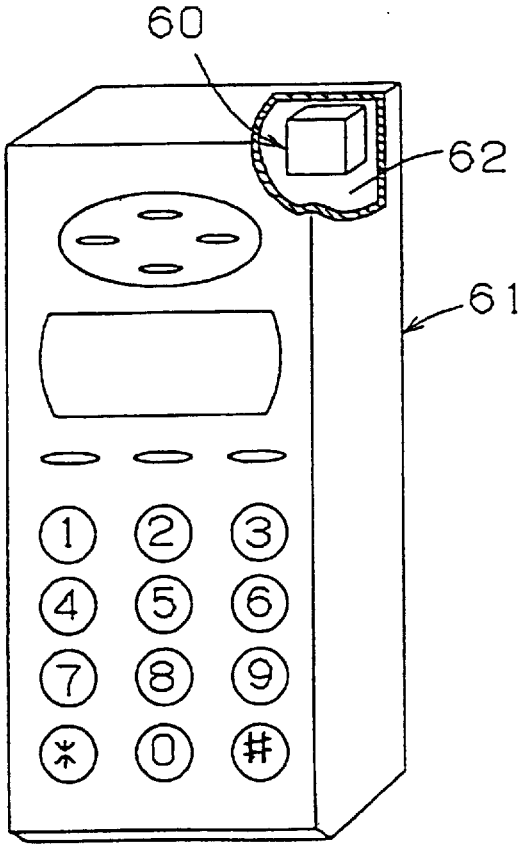
FIG. 9 is a perspective view of a communication apparatus according to the present invention.
Figure 10:
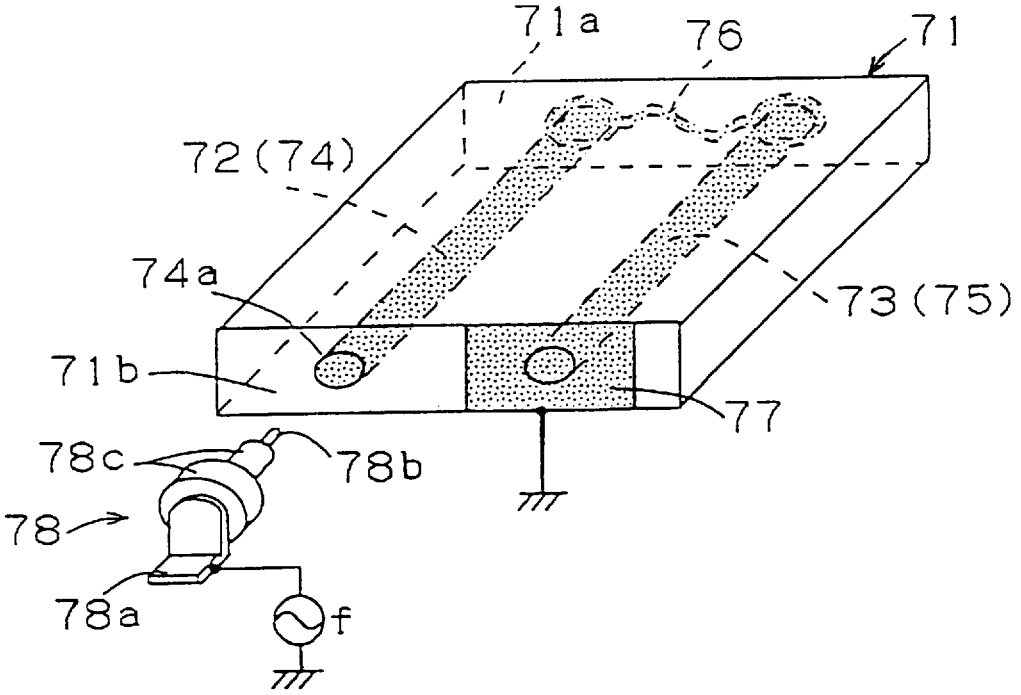
FIG. 10 PRIOR ART
FIG. 10 is a perspective view of a conventional surface-mount antenna.

FIG. 9 shows a communication apparatus, e.g. a radio transceiver such as a cellular telephone, in which one of the above-described surface-mount antennas is installed. A surface-mount antenna 60 is mounted on a set printed circuit board (or its sub printed circuit board) 62 of a communication apparatus 61 by soldering its ground terminal and power-supplying terminal.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A surface-mount antenna comprising:

a base member comprising at least one of a dielectric material and a magnetic material, the base member having a main surface and an end surface at an edge of the main surface, the end surface being dividable into end-face portions;

a through-hole formed between one end-face portion and an opposite end-face portion in said base member;

a ground electrode formed on said one end-face portion;

a radiation electrode formed on an inside surface of said through-hole, one end of said radiation electrode being connected to said ground electrode and another end comprising an open end on the opposite end-face portion; and a power-supplying electrode disposed around said open end on the opposite end-face portion, a gap being provided between the power supplying electrode and the radiation electrode.

2. The surface-mount antenna of claim 1, wherein the base member comprises a rectangular parallelopiped.

3. The surface-mount antenna of claim 1 wherein the gap is disposed on said opposite end-face portion between said open end and said power supplying electrode.

4. The surface-mount antenna of claim 1, herein a frequency of operation of the antenna can be changed by varying one of the size of said gap, the size of the ground electrode and the size of the open end.

5. The surface-mount antenna of claim 1, wherein said gap comprises a capacitance.

6. A surface-mount antenna comprising:

a base member comprising at least one of a dielectric material and a magnetic material, the base member having a main surface and an end surface at an edge of the main surface, the end surface being dividable into end-face portions;

a through-hole formed between one end-face portion and an opposite end-face portion in said base member;

a ground electrode formed on said one end-face portion;

a power-supplying electrode formed on the opposite end-face portion; and a radiation electrode formed on a portion of an inside surface of said through-hole, part of said inside surface not having said radiation electrode;

wherein one end of said radiation electrode is connected to said ground electrode and the other end extends toward the opposite end-face portion and serves as an open end.

7. The surface-mount antenna of claim 6, wherein a capacitance is formed between said open end and said power supplying electrode.

8. The surface-mount antenna of claim 6, wherein the radiation electrode does not extend along the entire inside surface of said through hole, a gap being formed along a portion of the through hole not having said radiation electrode, said gap comprising a capacitance.

9. The surface-mount antenna of claim 6, wherein the base member comprises a rectangular parallelopiped.

10. The surface-mount antenna of claim 8, wherein a frequency of operation of the antenna can be changed by varying one of the size of said gap, the size of the ground electrode and the size of the open end.

11. A surface-mount antenna comprising:

a base member comprising at least one of a dielectric material and a magnetic material, the base member having a main surface and an end surface at an edge of the main surface, the end surface being dividable into end-face portions;

a hole in said base member extending from one end-face portion toward an opposite end-face portion, said hole terminating prior to said opposite end-face portion;

a radiation electrode formed on an inside surface of said hole; and a ground electrode formed on said one end-face portion;

wherein one end of said radiation electrode is connected to said ground electrode and another end comprises an open end near the opposite end-face portion; and a power-supplying electrode formed on the opposite end-face portion at a position in-line with an axis extending through the hole.

12. The surface-mount antenna of claim 11, wherein the base member comprises a rectangular parallelopiped.

13. The surface-mount antenna of claim 11, wherein a region of said base member between said open end and said power supplying electrode comprises a base-member gap comprising a capacitance.

14. The surface-mount antenna of claim 13, herein a frequency of operation of the antenna can be changed by varying one of the size of said gap, the size of the ground electrode and the size of the open end.

15. The surface-mount antenna of claim 11, wherein a capacitance is formed between said open end and said power supplying electrode.

16. A surface-mount antenna comprising:

a base member comprising at least one of a dielectric material and a magnetic material, the base member having a main surface and an end surface at an edge of the main surface, the end surface being dividable into end-face portions;

at least a first through-hole and a second through-hole formed between one end-face portion and an opposite end-face portion in said base member;

a pattern electrode formed on said one end-face portion;

a ground electrode formed on the opposite end-face portion; and a first radiation electrode and a second radiation electrode formed on inside surfaces of said first through-hole and said second through-hole, respectively;

wherein one end of each of said first radiation electrode and said second radiation electrode is connected to said pattern electrode;

another end of said first radiation electrode comprising an open end on the opposite end-face portion;

another end of said second radiation electrode connected to said ground electrode; and a power-supplying electrode disposed around said open end on the opposite end-face portion, a gap being provided between the power supplying electrode and the radiation electrode.

17. The surface-mount antenna of claim 16, wherein the base member comprises a rectangular parallelopiped.

18. The surface-mount antenna of claim 16, wherein the gap is disposed on said one end-face portion between said open end and said power-supplying electrode.

19. The surface-mount antenna of claim 16, wherein a frequency of operation of the antenna can be changed by varying one of the size of said gap, the size of the ground electrode and the size of the open end.

20. The surface-mount antenna of claim 16, wherein said gap comprises a capacitance.

21. A surface-mount antenna comprising:

a base member comprising at least one of a dielectric material and a magnetic material, the base member having a main surface and an end surface at an edge of the main surface, the end surface being dividable into end-face portions;

at least a first through-hole and a second through-hole formed between one end-face portion and an opposite end-face portion in said base member;

a pattern electrode formed on the opposite end-face portion;

a power-supplying electrode formed on said one end-face portion;

a ground electrode formed on said one end-face portion; and a first radiation electrode and a second radiation electrode formed on inside surfaces of said first through-hole and said second through-hole, respectively;

wherein one end of each of said first radiation electrode and said second radiation electrode is connected to said pattern electrode;

another end of said first radiation electrode extends toward said power-supplying electrode and comprises an open end; and another end of said second radiation electrode is connected to said ground electrode.

22. The surface-mount antenna of claim 21, wherein a capacitance is formed between said open end and said power supplying electrode.

23. The surface-mount antenna of claim 21, wherein the first radiation electrode does not extend along the entire inside surface of said first through-hole, a gap being formed along a portion of the through-hole not having said first radiation electrode, said gap comprising a capacitance.

24. The surface-mount antenna of claim 21, wherein the base member comprises a rectangular parallelopiped.

25. The surface-mount antenna of claim 23, wherein a frequency of operation of the antenna can be changed by varying one of the size of said gap, the size of the ground electrode and the size of the open end.

26. A surface-mount antenna comprising:

a base member comprising at least one of a dielectric material and a magnetic material, the base member having a main surface and an end surface at an edge of the main surface, the end surface being dividable into end-face portions;

a hole in said base member extending from one end-face portion toward an opposite end-face portion, said hole terminating prior to said opposite end-face portion;

at least one through-hole formed between said one end-face portion and the opposite end-face portion;

a pattern electrode formed on said one end-face portion;

a ground electrode formed on the opposite end-face portion; and a first radiation electrode and a second radiation electrode formed on inside surfaces of said hole and said through-hole, respectively;

wherein one end of said first radiation electrode in said hole is connected to said pattern electrode and another end of said first radiation electrode comprises an open end near the opposite end-face portion;

a power-supplying electrode formed on the opposite end-face portion at a position in-line with an axis extending through said hole, and one end of said second radiation electrode being connected to said pattern electrode and another end of said second radiation electrode being connected to said ground electrode.

27. The surface-mount antenna of claim 26, wherein the base member comprises a rectangular parallelopiped.

28. The surface-mount antenna of claim 26, wherein a region of said base member between said open end and said power-supplying electrode comprises a base member gap comprising a capacitance.

29. The surface-mount antenna of claim 28, wherein a frequency of operation of the antenna can be changed by varying one of the size of said gap, the size of the ground electrode and the size of the open end.

30. The surface-mount antenna of claim 26, wherein a capacitance is formed between said open end and said power supplying electrode.

31. A communication apparatus comprising:

at least one of an electromagnetic frequency receiver and transmitter;

a surface-mount antenna coupled to at least one of the transmitter and receiver;

the surface-mount antenna comprising:

a base member comprising at least one of a dielectric material and a magnetic material, the base member having a main surface and an end surface at an edge of the main surface, the end surface being dividable into end-face portions;

a through-hole formed between one end-face portion and an opposite end-face portion in said base member;

a ground electrode formed on said one end-face portion;

a radiation electrode formed on an inside surface of said through-hole, one end of said radiation electrode being connected to said ground electrode and another end comprising an open end on the opposite end-face portion; and a power-supplying electrode disposed around said open end on the opposite end-face portion, a gap being provided between the power supplying electrode and the radiation electrode.

32. A communication apparatus comprising:

at least one of an electromagnetic frequency receiver and transmitter;

a surface mount antenna coupled to at least one of the transmitter and receiver;

the surface-mount antenna comprising:

a base member comprising at least one of a dielectric material and a magnetic material, the base member having a main surface and an end surface at an edge of the main surface, the end surface being dividable into end-face portions;

a through-hole formed between one end-face portion and an opposite end-face portion in said base member;

a ground electrode formed on said one end-face portion;

a power-supplying electrode formed on the opposite end-face portion; and a radiation electrode formed on a portion of an inside surface of said through-hole, part of said inside surface not having said radiation electrode;

wherein one end of said radiation electrode is connected to said ground electrode and the other end extends toward the opposite end-face portion and serves as an open end.

33. A communication apparatus comprising:

at least one of an electromagnetic frequency receiver and transmitter;

a surface mount antenna coupled to at least one of the transmitter and receiver;

the surface-mount antenna comprising:

a base member comprising at least one of a dielectric material and a magnetic material, the base member having a main surface and an end surface at an edge of the main surface, the end surface being dividable into end-face portions;

a hole in said base member extending from one end-face portion toward an opposite end-face portion, said hole terminating prior to said opposite end-face portion;

a radiation electrode formed on an inside surface of said hole; and a ground electrode formed on said one end-face portion;

wherein one end of said radiation electrode is connected to said ground electrode and another end comprises an open end near the opposite end-face portion; and a power-supplying electrode formed on the opposite end-face portion at a position in-line with an axis extending through the hole.

34. A communication apparatus comprising:

at least one of an electromagnetic frequency receiver and transmitter;

a surface mount antenna coupled to at least one of the transmitter and receiver;

the surface-mount antenna comprising:

a base member comprising at least one of a dielectric material and a magnetic material, the base member having a main surface and an end surface at an edge of the main surface, the end surface being dividable into end-face portions;

at least a first through-hole and a second through-hole formed between one end-face portion and an opposite end-face portion in said base member;

a pattern electrode formed on said one end-face portion;

a ground electrode formed on the opposite end-face portion; and a first radiation electrode and a second radiation electrode formed on inside surfaces of said first through-hole and said second through-hole, respectively;

wherein one end of each of said first radiation electrode and said second radiation electrode is connected to said pattern electrode;

another end of said first radiation electrode comprising an open end on the opposite end-face portion;

another end of said second radiation electrode connected to said ground electrode; and a power-supplying electrode disposed around said open end on the opposite end-face portion, a gap being provided between the power supplying electrode and the radiation electrode.

35. A communication apparatus comprising:

at least one of an electromagnetic frequency receiver and transmitter;

a surface mount antenna coupled to at least one of the transmitter and receiver;

the surface-mount antenna comprising:

a base member comprising at least one of a dielectric material and a magnetic material, the base member having a main surface and an end surface at an edge of the main surface, the end surface being dividable into end-face portions;

at least a first through-hole and a second through-hole formed between one end-face portion and an opposite end-face portion in said base member;

a pattern electrode formed on the opposite end-face portion;

a power-supplying electrode formed-on said one end-face portion;

a ground electrode formed on said one end-face portion; and a first radiation electrode and a second radiation electrode formed on inside surfaces of said first through-hole and said second through-hole, respectively;

wherein one end of each of said first radiation electrode and said second radiation electrode is connected to said pattern electrode;

another end of said first radiation electrode extends toward said power-supplying electrode and comprises an open end; and another end of said second radiation electrode is connected to said ground electrode.

36. A communication apparatus comprising:

at least one of an electromagnetic frequency receiver and transmitter;

a surface mount antenna coupled to at least one of the transmitter and receiver;

the surface-mount antenna comprising:

a base member comprising at least one of a dielectric material and a magnetic material, the base member having a main surface and an end surface at an edge of the main surface, the end surface being dividable into end-face portions;

a hole in said base member extending from one end-face portion toward an opposite end-face portion, said hole terminating prior to said opposite end-face portion;

at least one through-hole formed between said one end-face portion and the opposite end-face portion;

a pattern electrode formed on said one end-face portion;

a ground electrode formed on the opposite end-face portion; and a first radiation electrode and a second radiation electrode formed on inside surfaces of said hole and said through-hole, respectively;

wherein one end of said first radiation electrode in said hole is connected to said pattern electrode and another end of said first radiation electrode comprises an open end near the opposite end-face portion;

a power-supplying electrode formed on the opposite end-face portion at a position in-line with an axis extending through said hole, and one end of said second radiation electrode being connected to said pattern electrode and another end of said second radiation electrode being connected to said ground electrode.

37. A surface-mount antenna comprising:

a base member comprising at least one of a dielectric material and a magnetic material, the base member having a main surface and an end surface at an edge of the main surface, the end surface being dividable into end-face portions;

a hole provided between one end-face portion and extending toward an opposite end-face portion in said base member;

a ground electrode formed on an end-face portion;

a radiation electrode formed on an inside surface of said hole, one end of said radiation electrode being coupled to said ground electrode and another end comprising an open end;

a power-supplying electrode formed on an end-face portion; and a capacitance being provided between said power-supplying electrode and said open end of the radiation electrode.

38. The surface mount antenna of claim 37, wherein the base member comprises a rectangular parallelopiped.

39. The surface mount antenna of claim 37, wherein said hole comprises a through-hole and said radiation electrode extends from said one end-face portion to the opposite end-face portion and said capacitance comprises a gap disposed on said one end-face portion between said open end and said power-supplying electrode.

40. The surface mount antenna of claim 37, wherein the frequency of operation of the antenna can be changed by varying one of the size of said capacitance, the size of the ground electrode and the size of the open end.

41. The surface mount antenna of claim 37, wherein the hole comprises a through-hole extending from said one end-face portion to the opposite end-face portion and wherein the radiation electrode does not extend along the entire inside surface of said through-hole, the capacitance being formed along a portion of the through-hole between the open end of said radiation electrode and said power-supplying electrode.

42. The surface mount antenna of claim 37, wherein said hole in said base member extends from said one end-face portion toward the opposite end-face portion, said hole terminating prior to said opposite end-face portion, the power supplying electrode being formed on the opposite end-face portion and in line with an axis extending through the hole.

43. The surface mount antenna of claim 42, wherein the capacitance comprises a distance through said base member between said power supplying electrode and a point in said base member where said hole terminates.

44. The surface mount antenna of claim 37, wherein the ground electrode is provided on said one end-face portion and the power-supplying electrode is provided on said opposite end-face portion.

45. The surface mount antenna of claim 37, further comprising a second hole formed between one end-face portion and an opposite end-face portion in said base member;

a pattern electrode disposed on said one end-face portion;

said ground electrode being disposed on the opposite end-face portion;

the power-supplying electrode being formed on said opposite end-face portion;

a second radiation electrode formed on an inside surface of said second hole;

one end of each of said first radiation electrode and said second radiation electrode being coupled to said pattern electrode;

another end of said second radiation electrode being coupled to said ground electrode.

46. The surface mount antenna of claim 45, wherein the pattern electrode has two ends, one end being coupled to said first radiation electrode and the other end being coupled to said second radiation electrode.

47. The surface mount antenna of claim 46, wherein said first and second holes comprise through-holes extending from one end-face portion to the opposite end-face portion in the base member, the second radiation electrode being formed on the inside surface of said second through-hole, the first radiation electrode does not extend along the entire inside surface of the first through-hole, a gap being formed along a portion of the first through-hole not having the radiation electrode, said gap comprising a capacitance.

48. The surface mount antenna of claim 45, wherein said hole in said base member extends from said one end-face portion toward the opposite end-face portion, said hole terminating prior to said opposite end-face portion, the power supplying electrode being formed on the opposite end-face portion and in line with an axis extending through the hole.

49. The surface mount antenna of claim 45, wherein said hole comprises a through-hole and said radiation electrode extends from said one end-face portion to the opposite end-face portion and said capacitance comprises a gap disposed on said one end-face portion between said open end and said power-supplying electrode.

50. A surface-mount antenna comprising:

a base member comprising at least one of a dielectric material and a magnetic material, the base member having a first surface and a second surface;

a hole provided between said first surface and said second surface in said base member;

a ground electrode formed on said first surface;

a radiation electrode formed on an inside surface of said hole, one end of said radiation electrode being connected to said ground electrode and another end comprising an open end adjacent to said second surface; and a power-supplying electrode disposed around said open end, the open end being coupled to said power-supplying electrode via a means for forming capacitance.

51. The surface mount antenna of claim 50 wherein the hole comprises a through-hole extending between the first and second surfaces.

52. The surface mount antenna of claim 50 wherein the hole comprises a hole extending from the first surface and terminating before the second surface in the base member.

53. The surface mount antenna of claim 50, wherein the means for forming a capacitance comprises a dielectric member disposed on said second surface, the power supplying electrode being disposed on an exposed surface of the dielectric member.

54. The surface mount antenna of claim 53, wherein the dielectric member comprises a resin material.

55. A surface-mount antenna comprising:

a base member comprising at least one of a dielectric material and a magnetic material, the base member having a first surface and a second surface;

a hole provided between said first surface and said second surface in said base member;

a ground electrode formed on said first surface;

a radiation electrode formed on an inside surface of said hole, one end of said radiation electrode being connected to said ground electrode and another end comprising an open end adjacent to said second surface; and a power-supplying electrode disposed around said open end, the open end being coupled to said power-supplying electrode via a capacitance.

56. The surface mount antenna of claim 55 wherein the hole comprises a through-hole extending between the first and second surfaces.

57. The surface mount antenna of claim 55 wherein the hole comprises a hole extending from the first surface and terminating before the second surface in the base member.

58. The surface mount antenna of claim 55, wherein the capacitance comprises a dielectric member disposed on said second surface, the power supplying electrode being disposed on an exposed surface of the dielectric member.

59. The surface mount antenna of claim 58, wherein the dielectric member comprises a resin material.

* * * * *